US012478862B2

(12) United States Patent
Pinilla

(10) Patent No.: US 12,478,862 B2
(45) Date of Patent: Nov. 25, 2025

(54) EDUCATIONAL TOY HAVING MULTIPLE DRAWERS

(71) Applicant: Yadira A. Pinilla, Alexandria, VA (US)

(72) Inventor: Yadira A. Pinilla, Alexandria, VA (US)

( * ) Notice: Subject to any disclaimer, the term of this patent is extended or adjusted under 35 U.S.C. 154(b) by 0 days.

(21) Appl. No.: 18/166,247

(22) Filed: Feb. 8, 2023

(65) Prior Publication Data

US 2023/0249057 A1 Aug. 10, 2023

Related U.S. Application Data

(60) Provisional application No. 63/372,043, filed on Feb. 9, 2022.

(51) Int. Cl.
*A63F 9/06* (2006.01)
*A63F 9/24* (2006.01)

(52) U.S. Cl.
CPC ..... *A63F 9/0666* (2013.01); *A63F 9/24* (2013.01); *A63F 2009/2442* (2013.01); *A63F 2009/2476* (2013.01)

(58) Field of Classification Search
CPC .. A63F 9/0666; A63F 9/24; A63F 2009/2442; A63F 2009/2476; A63F 2009/1033
See application file for complete search history.

(56) References Cited

U.S. PATENT DOCUMENTS 1,987,496 A * 1/1935 Springborn ..... A63F 9/1044 273/157 R
4,447,098 A * 5/1984 Parker ..... E05B 65/464 312/107.5
4,637,667 A * 1/1987 Reid ..... E05B 65/463 312/216
5,362,054 A * 11/1994 Ashemimry ..... A63F 9/12 273/157 R
5,599,077 A * 2/1997 Law ..... E05B 65/464 312/215
5,683,112 A * 11/1997 McQueeny ..... A63F 9/1044 281/31
2003/0025425 A1* 2/2003 Cheng ..... E05B 65/464 312/219
2004/0232809 A1* 11/2004 Buchman-Ziv ..... B44C 3/12 312/293.2

(Continued)

FOREIGN PATENT DOCUMENTS

CN 204480539 U * 7/2015
CN 208389394 U * 1/2019

(Continued)

OTHER PUBLICATIONS

Human translation of CN 204480539 U. pp. 1-24. (Year: 2015).*

*Primary Examiner* — Steven B Wong

(57) ABSTRACT

An educational toy and systems, methods, and components thereof can include a body, a plurality of drawers at a front side of the body, and a plurality of puzzle pieces. The drawers can be vertically aligned with each other. Each of the drawers can be movable between a fully open position and a fully closed position. Each drawer can include: a puzzle surface having a set of receptacles to receive a predefined set of the plurality of puzzle pieces, and a handle extending from a front face of the drawer.

17 Claims, 11 Drawing Sheets

(56) References Cited

U.S. PATENT DOCUMENTS

| | | | | |
|---|---|---|---|---|
| 2005/0253336 | A1* | 11/2005 | Schwartz | A63F 9/10 273/157 R |
| 2007/0152400 | A1* | 7/2007 | Cooper | A63F 9/10 273/157 R |
| 2012/0024729 | A1* | 2/2012 | Dietenberger | A63F 9/10 206/315.1 |
| 2014/0167575 | A1* | 6/2014 | Freimuth | E05B 65/462 312/220 |
| 2016/0174707 | A1* | 6/2016 | Chan | E05C 17/50 312/333 |
| 2016/0303471 | A1* | 10/2016 | Renner | A63F 9/0666 |
| 2021/0077899 | A1* | 3/2021 | Tatonetti | A63F 9/10 |
| 2023/0348141 | A1* | 11/2023 | Zhurin | B65D 75/54 |

FOREIGN PATENT DOCUMENTS

| | | | | | |
|---|---|---|---|---|---|
| CN | 209790836 | U | * | 12/2019 | |
| CN | 210402848 | U | * | 4/2020 | |
| CN | 214253438 | U | * | 9/2021 | |
| CN | 218853457 | U | * | 4/2023 | |
| DE | 19956154 | B4 | * | 9/2005 | |
| GB | 2095322 | A | * | 9/1982 | E05B 65/464 |

* cited by examiner

EDUCATIONAL TOY HAVING MULTIPLE DRAWERS

TECHNICAL FIELD

The present disclosure relates to an educational toy, in particular, an educational toy for a child, and systems, methods, and components thereof.

SUMMARY

According to one or more aspects, an educational apparatus for a child can be provided or is disclosed. The educational apparatus can comprise: a body having a top side, a bottom side opposite the top side, a rear side, a first side, a second side opposite the first side, and a front side opposite the rear side; a plurality of drawers vertically aligned with each other on the front side of the body; and a plurality of puzzle pieces. Each of the drawers can be movable between a fully open position and a fully closed position. Each of the drawers can include: a puzzle surface having a set of receptacles to receive a predefined set of the plurality of puzzle pieces, and a handle extending from a front face of the drawer.

According to one or more other aspects, a method can be implemented or is disclosed. The method can comprise: providing an educational toy including a body and a plurality of drawers slidably coupled to the body, the drawers being in vertical alignment with each other, and the drawers each having a front plate on a front face side of the body; and providing a plurality of puzzle pieces for each of the drawers. Each of the drawers can be slidable between a fully open position and a fully closed position. Each of the drawers can include: a puzzle surface having a set of receptacles to receive a predefined set of the plurality of puzzle pieces, a handle extending from the front plate of the drawer, and a set of indicia corresponding to the predefined set of the plurality of puzzle pieces.

According to yet one or more other aspects, an educational toy for a child can be provided or is disclosed. The educational toy can comprise: a body in the form of a square cube having a top side, a bottom side opposite the top side, a rear side, a first side, a second side opposite the first side, and a front side opposite the rear side; a plurality of drawers provided on the front side of the body, the plurality of drawers including only four drawers and being vertically aligned with each other on the front side of the body; a top handle extending from the top side of the body; and a plurality of puzzle pieces. Each of the plurality of drawers can be movable between a fully open position and a fully closed position. Each of the drawers can include: a body, a puzzle surface recessed in the body, the puzzle surface having a set of distinct recesses to receive a predefined set of the plurality of puzzle pieces, a handle extending from a front face of the body of the drawer, and a set of indicia corresponding to the predefined set of the plurality of puzzle pieces.

DETAILED DESCRIPTION

Embodiments of the disclosed subject matter can involve an educational toy, in particular, an educational toy for a child, and systems, methods, and components thereof.

FIGS. 1-6 show various views of an educational toy 100 according to one or more embodiments of the disclosed subject matter. The educational toy 100 may be used by a child (e.g., ages 2-5), for instance, a toddler. The educational toy 100, which may be referred to herein or characterized as an educational system or an educational apparatus, can include a body 110 and a plurality of drawers 150. The educational toy 100, or portions thereof (e.g., body 110, drawers 150, etc.), can be made of any suitable material or combination of materials, such as wood and/or plastic.

Figure 1:
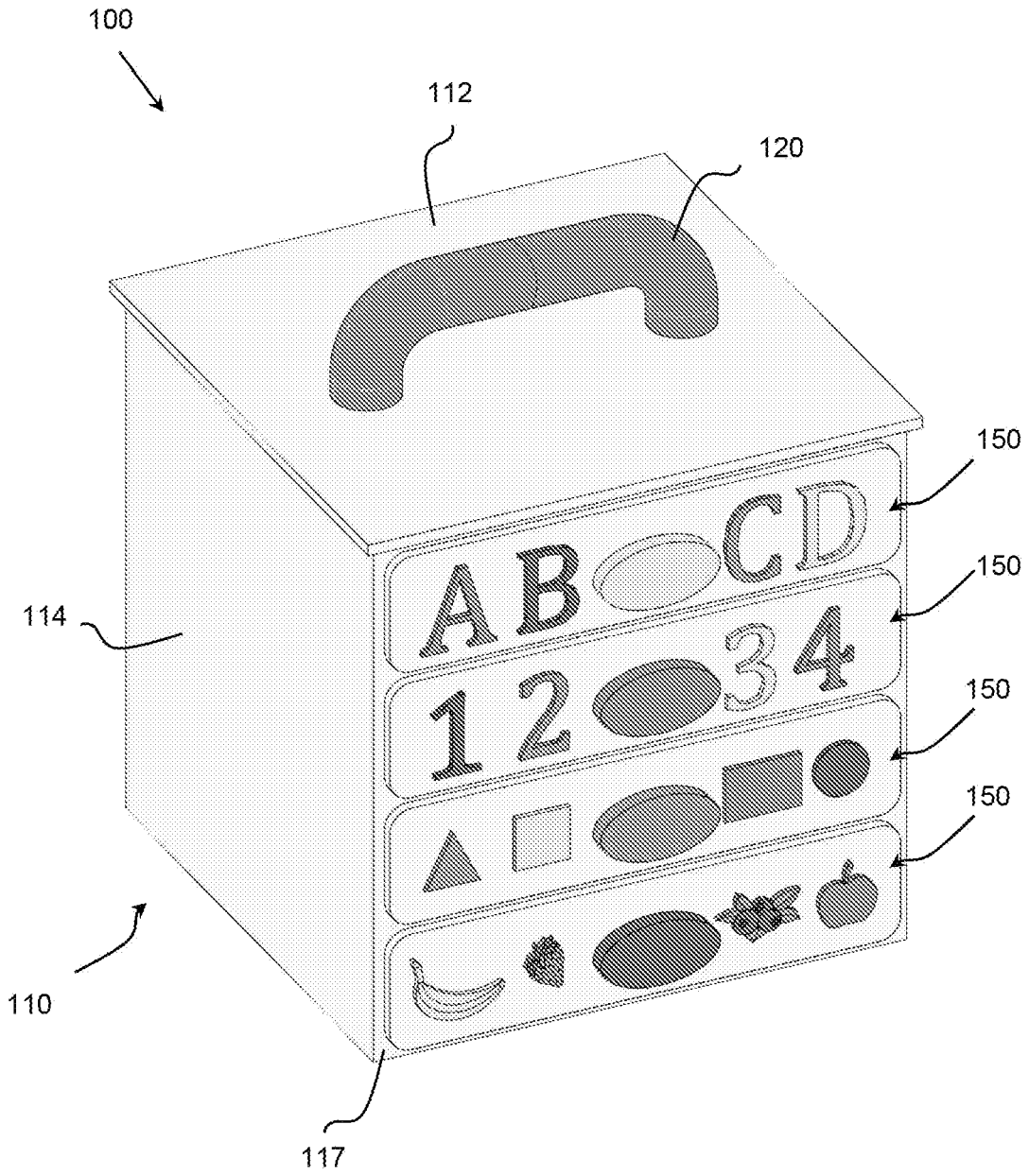
FIG. 1 is front, top perspective view of an educational toy according to one or more embodiments of the disclosed subject matter.
Figure 2:
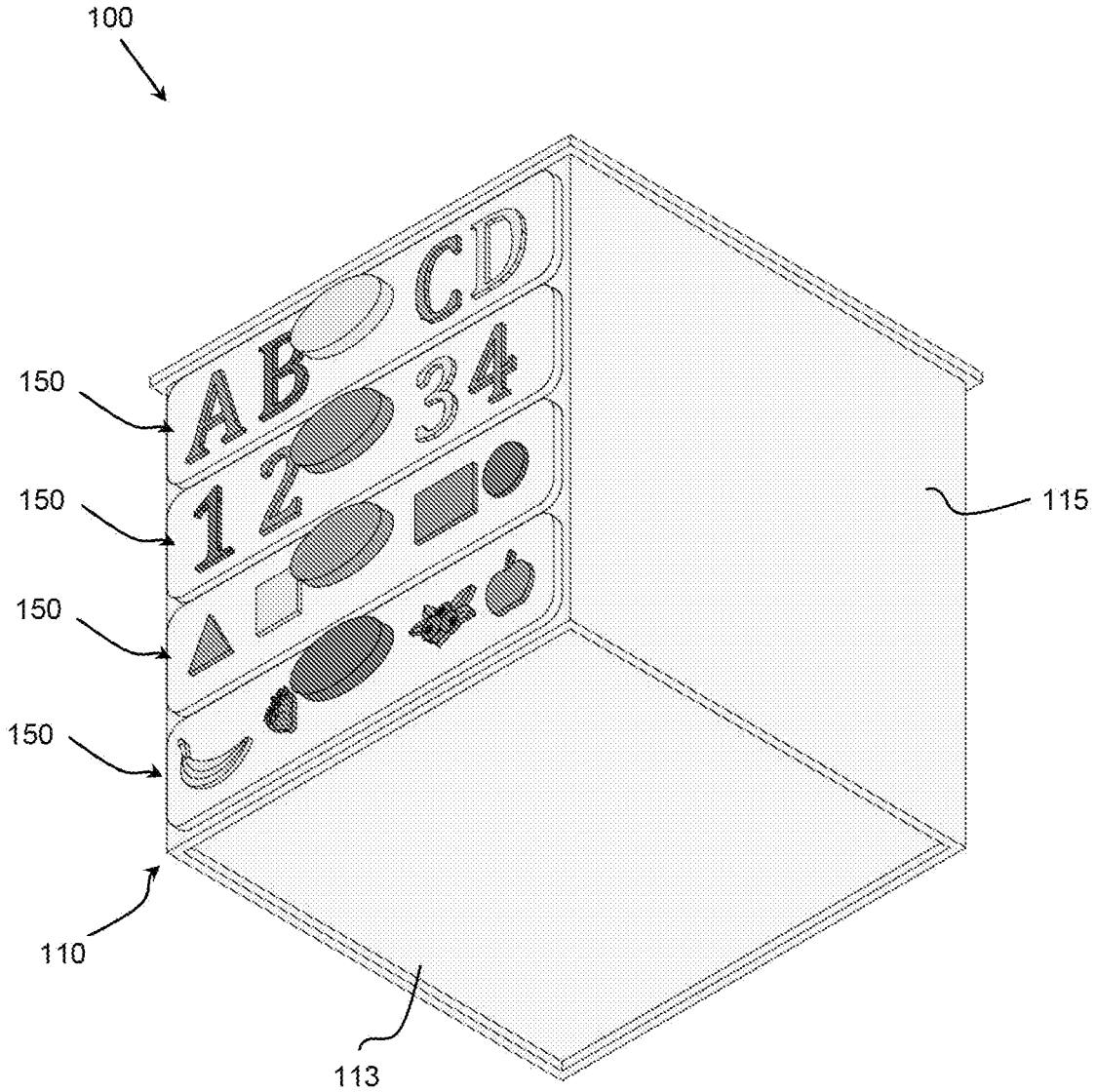
FIG. 2 is front, bottom perspective view of the educational toy of FIG. 1.

The body 110 can have a top side 112, a bottom side 113 opposite the top side 112, a left side 114, a right side 115 opposite the left side 114, a rear side 116, and a front side 117 opposite the rear side 116. Respective walls may define, at least in part, each of the top side 112, the bottom side 113, the left side 114, the right side 115, the rear side 116, and the front side 117. According to one or more embodiments, the body 110 can be in the form of a square cube, such as shown in FIGS. 1-6. Some or all of the foregoing sides may be referred to or characterized as faces. Optionally, the top side 112 of the body 110 may extend over, for instance, as a ledge, the left side 114, the right side 115, the rear side 116, and/or the front side 117, such as shown in FIGS. 1-6. Additionally, or alternatively, the bottom side 113 may be recessed with respect to the left side 114, the right side 115, the rear side 116, and the front side 117, such as shown in FIG. 2.

According to one or more embodiments, one or more handles can be provided for lifting and/or carrying the educational toy 100. For instance, FIG. 1 shows a handle 120 extending from the top side 112 of the body 110. Additionally, or alternatively, handles may be provided elsewhere on the body 110, for instance, on the left side 114 and the right side 115.

Figure 3:
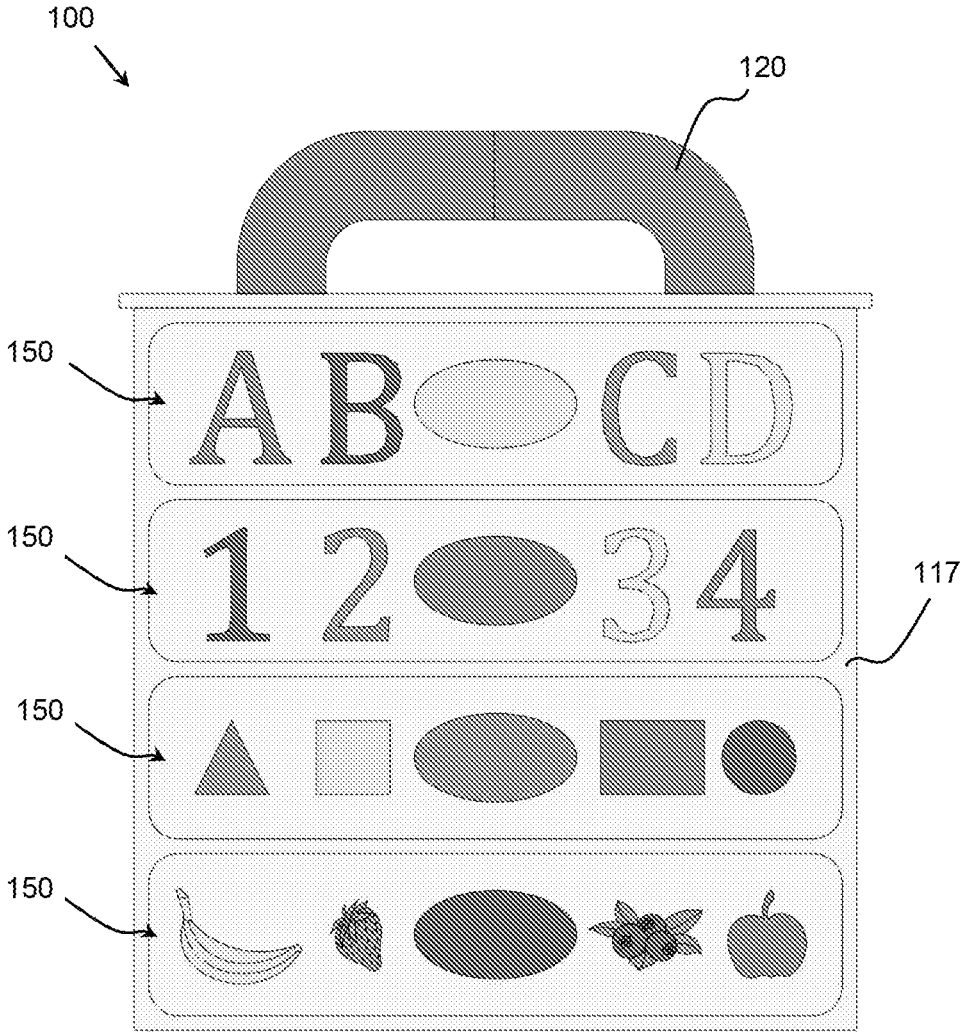
FIG. 3 is a front elevational view of the educational toy of FIG. 1.
Figure 4:
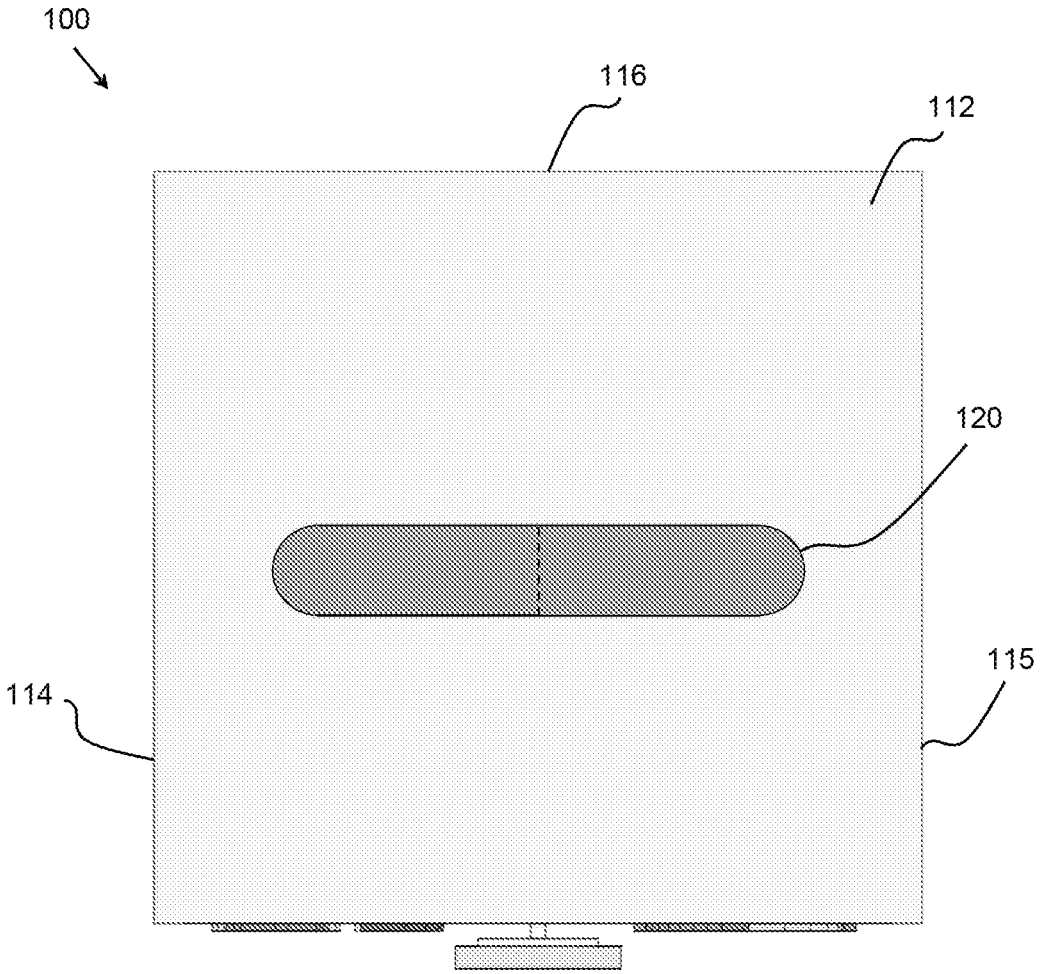
FIG. 4 is a top plan view of the educational toy of FIG. 1.
Figure 5:
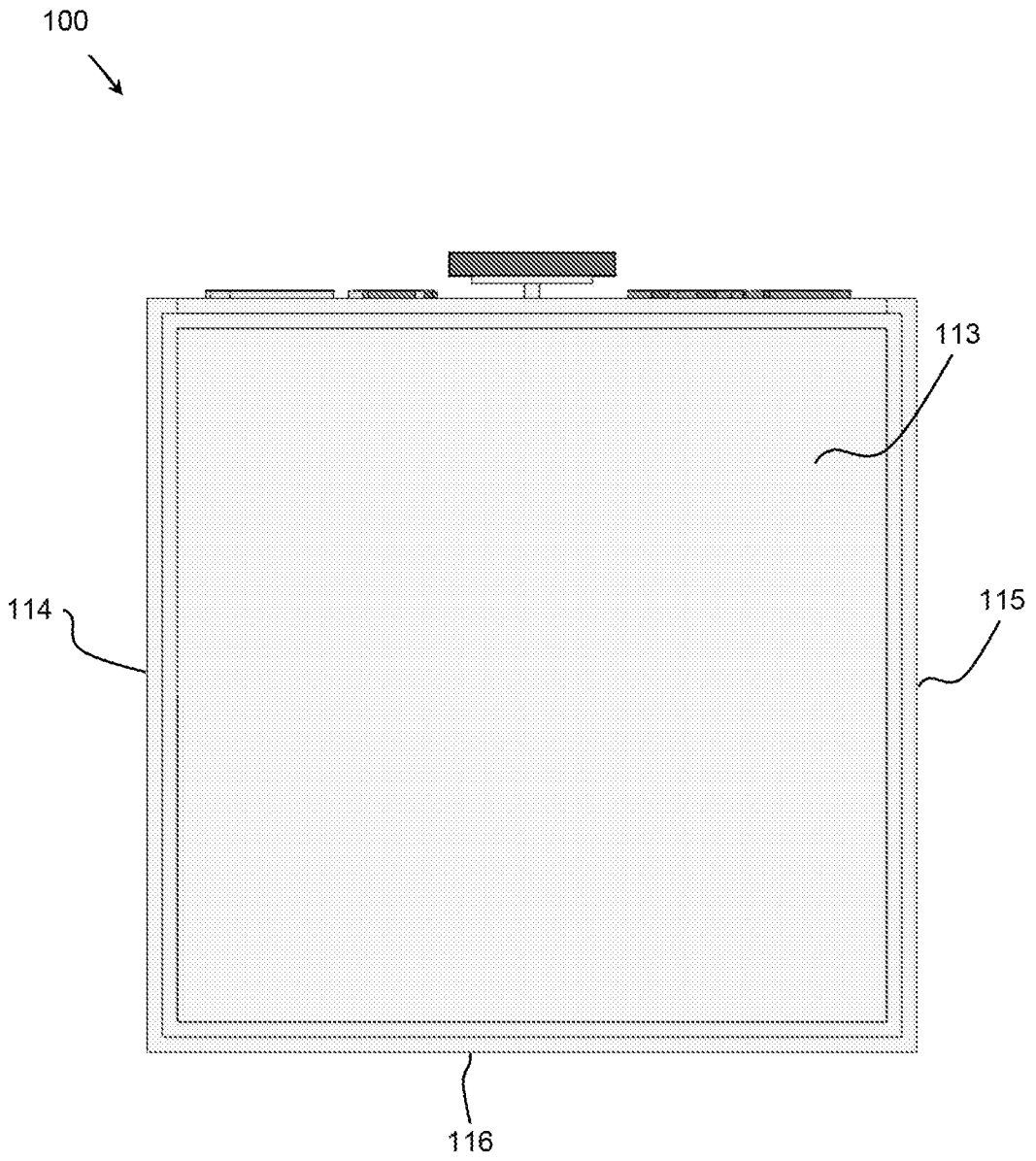
FIG. 5 is a bottom plan view of the educational toy of FIG. 1.
Figure 6:
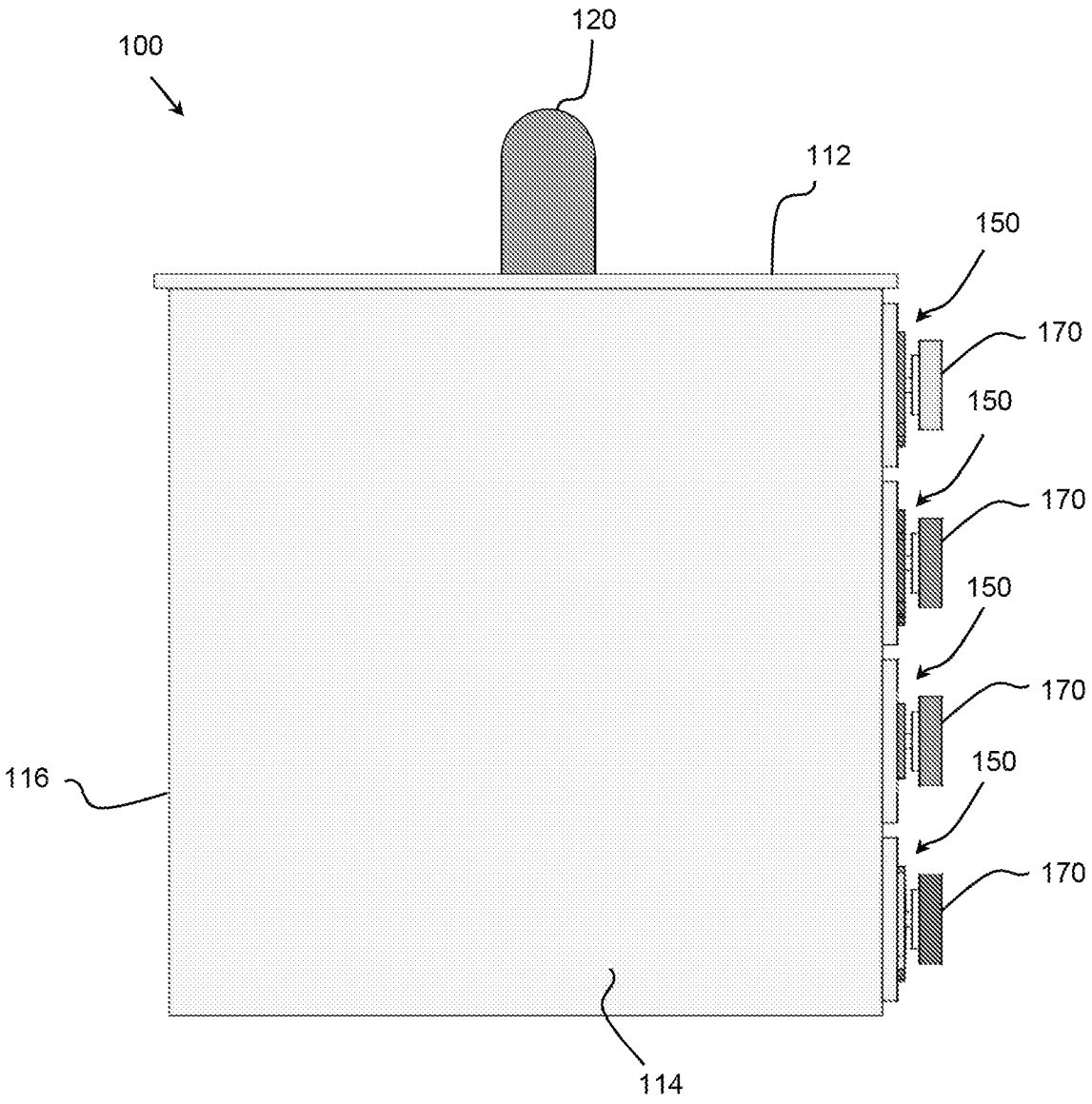
FIG. 6 is a left side elevational view of the educational toy of FIG. 1, the right side elevational view being a mirror image of the left side elevational view.
Figure 7A:
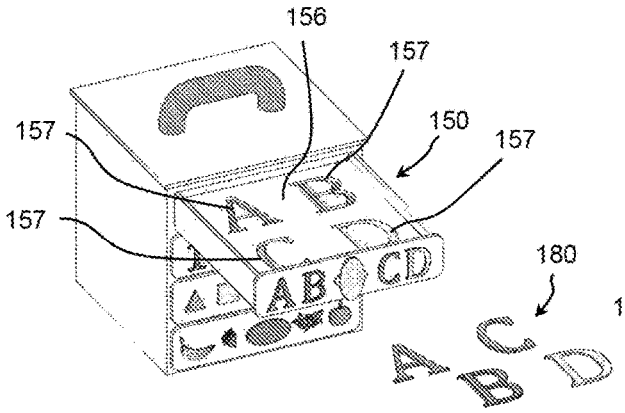
FIGS. 7A-7D show perspective views of the educational toy of FIG. 1 with a single drawer extended, according to one or more embodiments of the disclosed subject matter.
Figure 7B:
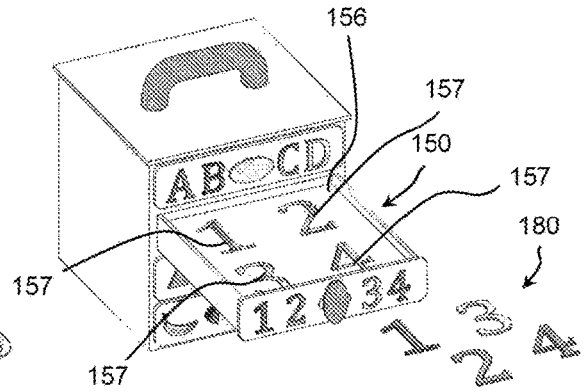
Figure 7C:
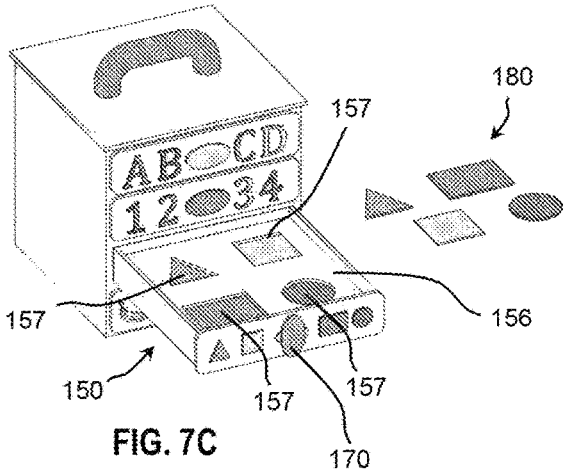
Figure 7D:
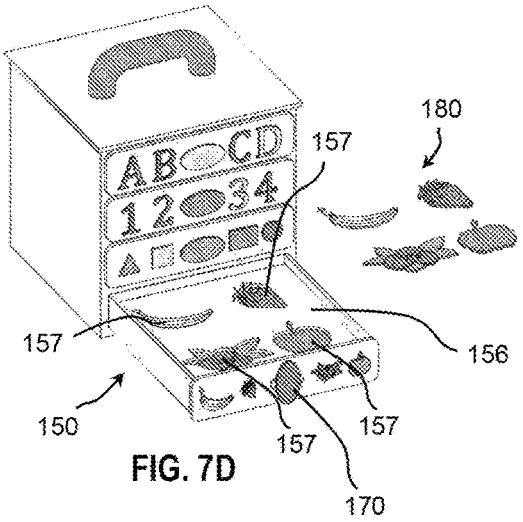

The drawers 150, which may be provided on the front side 117 of the body 110, can be vertically aligned with each other, such as shown in FIG. 3. According to one or more embodiments, only four drawers 150 may be provided. Additionally, or alternatively, in some embodiments, the drawers 150 could be side-by-side, for instance, two or three drawers aligned with each other horizontally.

The drawers 150 may be slidably coupled at the front side 117 of the body 110. In particular, each of the drawers 150 can be movable from a fully closed position, such as shown in FIG. 1, to a fully open or extended position, such as shown in FIGS. 7A-7D. Optionally, the drawers 150 and the body 110 may have tracks, rails, rollers, or the like to facilitate the movement of the drawers 150 between the fully closed position and the fully open position. The tracks, rails, or rollers (or the like) may also retain the drawers within the respective receptacles within the body 110. Optionally, a locking mechanism, which may be or include the tracks, rails, or rollers (or the like), can present the drawers from being completely removed from the body 110.

Figure 8:
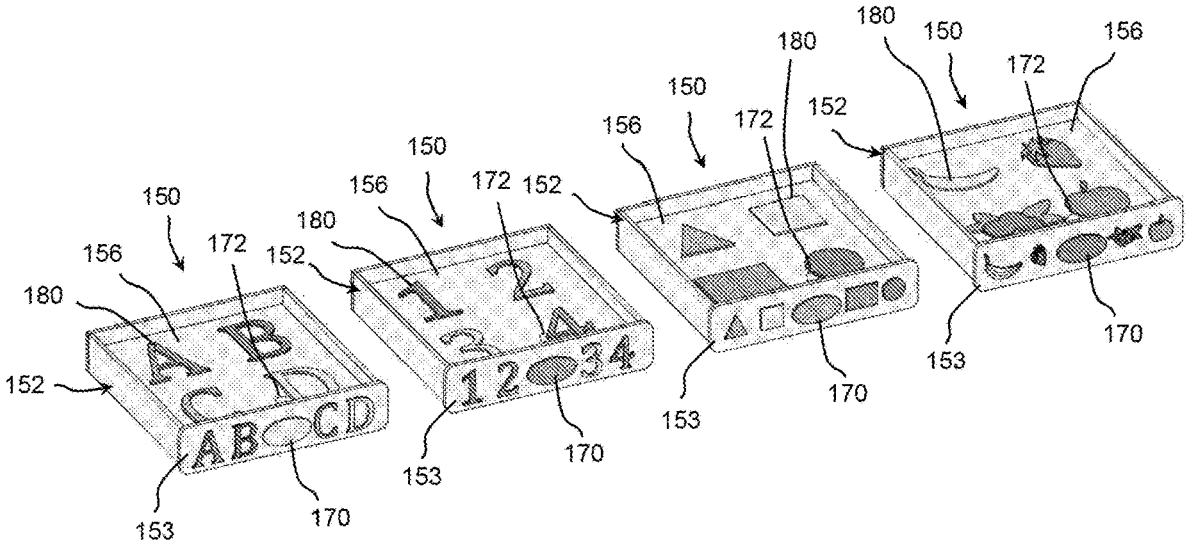
FIG. 8 shows exemplary drawers according to one or more embodiments of the disclosed subject matter.

Referring now to FIG. 8, each of the drawers 150 can have a body 152 and a puzzle surface 156. The body 152 can include a front wall or face 153, which may be in the form of a plate, as well as opposing side walls and a rear wall. The front wall 153 can be coupled to the side walls, and the side walls can be coupled to the rear wall. As shown in FIGS. 1-7D, when the drawer 150 is in the fully recessed or fully closed position, most of the body 152 of the drawer 150 can be in an internal volume of the body 110 of the educational toy 100. That is, in the fully closed position, only the front wall 153 of the drawer 150 may be outside of the body 110 of the educational toy 100, for instance, flush against the front side 117 of the body 110 of the educational toy 100. The drawers can have the same shape, dimensions, etc., except for the specific configuration of the puzzle surfaces 156 and the front wall 153.

The puzzle surface 156 can be provided inward of the front wall 153 as well as the side walls and the rear wall of the body 152 of the drawer 150. The puzzle surface 156 can be recessed or at a lower height than respective tops or upper surfaces of at least the side walls and the rear wall of the body 152. The puzzle surface 156 may also be recessed with respect to the top or upper surface of the front wall 153.

The puzzle surface 156 can have a plurality of receptacles 157, which may be distinct or separated from each other, to receive corresponding ones of puzzle pieces 180. The puzzle pieces 180 may be considered part of the educational toy 100. According to one or more embodiments, each of the receptacles 157 can be a recess to receive and retain, at least laterally, corresponding ones of the puzzle pieces 180. According to one or more embodiments, the puzzle surfaces 156 for the different drawers 150 can be different, for instance, having differently shaped receptacles 157 to receive corresponding differently shaped puzzle pieces 180, such as shown in FIGS. 7A-7D. Also shown in FIGS. 7A-7D, the receptacles 157 can show, in addition to the outline, the image or graphic of the corresponding puzzle piece 180 (e.g., including the same coloring).

The receptacles 157, per drawer 150, may be referred to or characterized as a predefined set of receptacles 157. Likewise, the puzzle pieces 180, per drawer 150, can be referred to or characterized as a predefined set of puzzle pieces 180. According to one or more embodiments, the sets of receptacles 157 and corresponding puzzle pieces 180 can include only four sets, such as shown in FIGS. 7A-7D. Optionally, the puzzle surface 156 can be removed from the drawer 150, for instance, and replaced with another puzzle surface 156 with a different set of receptacles 157 to receive a different set of puzzle pieces 180. According to one or more embodiments, each puzzle piece 180 may only correspond to one receptacle 157 in one of the drawers 150. Thus, each puzzle piece 180 may not be capable of being properly mated with more than one receptacle 157.

The puzzle pieces 180 may come in various shapes. Optionally, each predefined set of puzzle pieces 180 may be grouped according to a common theme. For instance, the predefined set of puzzle pieces 180 for one drawer 150 may be letters of the alphabet, the predefined set of puzzle pieces 180 for another drawer 150 may be numbers, the predefined set of puzzle pieces 180 for yet another drawer 150 may be shapes, and/or the predefined set of puzzle pieces 180 for another drawer 150 may be food (e.g., fruit). Other shapes, however, are envisioned. Generally, the shapes of the puzzle pieces 180 may be referred to or characterized as educational or learning shapes for a child, such as a toddler. The puzzle pieces 180 may be made of any suitable material or combination of materials, such as wood and/or plastic.

According to one or more embodiments, the puzzle pieces 180 may be retained on corresponding ones of the receptacles 157. For instance, in the case of the receptacle 157 being a recess, the puzzle piece 180, when provided (e.g., positioned) in the proper recess corresponding to the particular shape of the puzzle piece 180, can be retained, at least laterally, by the sidewalls of the puzzle surface 156 that form the recess. Additionally or alternatively, the receptacle 157 may have another means by which to removably couple the correct puzzle piece 180 to the receptacle 157. For instance, a magnetic force (via one or more magnets in the recess of the puzzle piece 180) can loosely retain the puzzle piece 180 in the correct position over the corresponding receptacle 157.

According to one or more embodiments, the thickness of the puzzle pieces 180 may be such that the puzzle pieces 180 can be manually (e.g., one or two hands) removed from the corresponding receptacle 157. For instance, the thickness of the puzzle piece 180 may be thicker than the depth of the receptacle 157 in the form of a recess by ½, ⅓, or ¼. Additionally, or alternatively, each puzzle piece 180 may have a handle extending from an upper surface thereof. However, the thickness of the puzzle pieces 180 may not be such that the puzzle piece 180 extends such that the drawer 150 cannot be closed with the puzzle pieces 180 in their proper receptacles 157. For instance, according to one or more embodiments, the puzzle pieces 180 may not extend above the top or upper surfaces of the rear wall or side walls of the body 152 of the drawer 150. Thus, each drawer 150 can be fully closed when the corresponding set of puzzle pieces 180 are properly provided in their respective receptacles 157.

The front wall 153 of each of the drawers 150 can have a set of indicia 160. The set of indicia 160 can correspond to the predefined set of puzzle pieces 180 associated with the particular drawer 150 (and also the predefined set of receptacles 157). According to one or more embodiments, each of the indicia 160 can be in color according to a primary color or a secondary color. In that the indicia 160 can be the same shape as the puzzle pieces 180 associated with the particular drawer 150, the indicia 160 may also be referred to or characterized as educational or learning shapes for a child, such as a toddler.

A handle 170, which may be considered part of the drawer 150, can extend or project from the front wall 153 of each of the drawers 150. According to one or more embodiments, each of the handles 170 may be a primary color or a secondary color, for instance, different from each of the other handles 170.

Each handle 170 may be rotatable, for instance, by ninety degrees, to lock or unlock the drawer 150 when in the fully closed position. For instance, in FIGS. 7A-7D, the horizontal position of the handle 170 can represent the locked position, and the vertical position (of the opened drawer) can represent the unlocked position. When the handle 170 is in the unlocked position the drawer 150 may be accessed by sliding the drawer 150 from the fully closed position to the fully open position. Thus, a locking mechanism 172 may be provided and may be operatively coupled to the handle 170 via a rotating rod, axle, or the like. FIG. 8 shows an exemplary locking mechanism 172 in the form of a tab or flange (shown in dashed lines so as to not obscure the puzzle pieces 180). According to one or more embodiments, only one of the drawers 170 may be able to be opened at one time, such as shown in FIGS. 7A-7D. Thus, according to one or more embodiments, when any of the drawers 170 is even ajar (i.e., not in the fully closed position), none of the other drawers 150 may be able to be opened.

Figure 9:
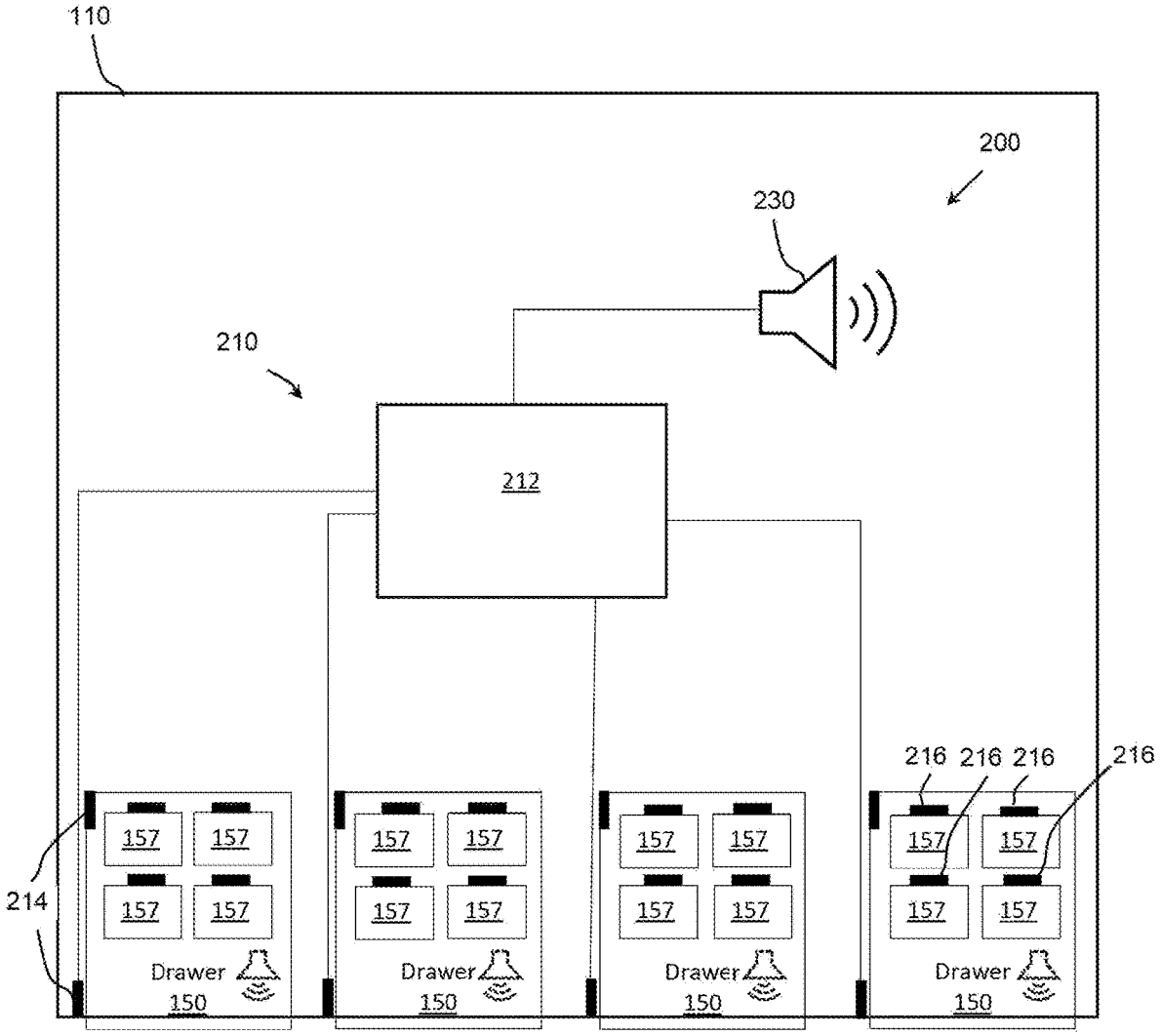
FIG. 9 is a block diagram of a system according to one or more embodiments of the disclosed subject matter.

FIG. 9 is a block diagram of a system 200 according to one or more embodiments of the disclosed subject matter. Generally, portions of the system 200 can be inside the body 110, and portions of the system 200 can be in or on each of the drawers 150. The system 200 can be comprised of circuitry 210 and one or more speakers 230. According one or more embodiments, a speaker 230 can be provided in the body 110 of the educational toy 100, outside of the drawers 150. Additionally, or alternatively, each drawer 150 can include a speaker 230.

The circuitry 210 can include a processor 212, which may include memory, and which may be implemented in or using processing circuitry. The processor 212 can be operatively coupled to the speaker 230 via wiring (in the case of speakers provided in the drawers 150, wiring can connect the speakers and the processor 212).

The circuitry 210 can include a position detector 214 to detect or determine position of each of the drawers 150, for instance, whether the drawer 150 is in the fully open or extended position. According to one or more embodiments, the position detector 214 can be a switching mechanism or device associated with each of the drawers 150. The position detector 214, which may be operatively coupled to the processor 212 via wiring, for instance, can be in the form of mechanical switches or relays or the like associated with each of the drawers 150, such as shown diagrammatically in FIG. 9. Alternatively, the position detector 214 may take the form of an optical sensor or a laser sensor to detect positioning of the drawer 150. For instance, when one of the drawers 150 is extended to the fully open position, this may complete a circuit that generates signaling to the processor 212 indicating that the drawer 150 is in the fully open position. Optionally, signaling may be output to the processor 212 when the position detector 214 detects that the drawer has been moved to the fully closed position (or is in the fully closed position). The position detector 214 can output signaling for each of the drawers 150 at the same time. Thus, the processor 212 can know the states of each of the drawers 150.

When the processor 212, via the position detector 214, detects that one of the drawers 150 has been extended from the fully closed state, for instance, to the fully extended state, the processor 212 can control the speaker 230 to output predefined sound. For instance, a tone, a message, and/or a song may be output from the speaker 230. The predefined sound to be output may be stored in memory of the processor 212. Optionally, the memory may be updated or reprogrammed to change the sound. As an example, when one of the drawers 150 is determined to have been opened to the fully open state, the speaker 230 can output a voice prompt to instruct the user (i.e., the child) to take further action, such as removing the puzzle pieces 180 from the drawer 150.

The circuitry 210 also may have a detector 216 to detect a state or positioning of the puzzle piece 180 in the receptacle 157. A detector 216, or detector portion, can be associated with each receptacle 157 of each drawer 150. The detector 216, which can be operatively coupled to the processor 212 via wiring (not shown), such as a wire bundle, can detect when one of the puzzle pieces 180 has been properly provided (e.g., fitted into the corresponding recess) for the receptacle 157. The detector 216, per receptacle 157, can be in the form of a switch (e.g., depression switches in the sidewall of the receptacle 157 in the form of a recess, or contacts or the like, that can indicate whether or not the puzzle piece 180 is properly provided in the receptacle 157. For instance, when one of the puzzle pieces 180 is properly fitted into its corresponding receptacle 157, this may complete a circuit that generates signaling to the processor 212 indicating that the puzzle piece 180 has been properly placed in its corresponding receptacle 157. Optionally, the detector 216 may only be operation when the corresponding drawer 150 is identified, by the processor 212, to be in the fully open or extended position.

When the processor 212, via the detector 216, detects that one of the puzzle pieces 180 has been properly provided in its corresponding receptacle 157, the processor 212 can control the speaker 230 to output predefined sound (alternatively, the speaker in the drawer may output the predefined sound). For instance, a tone, a message, and/or a song may be output from the speaker 230. The predefined sound to be output may be stored in memory of the processor 212. Optionally, the memory may be updated or reprogrammed to change the sound. As an example, one of the puzzle pieces 180 has been properly provided in its corresponding receptacle 157, the speaker 230 can output an audible message naming the shape. For instance, audible message "TRIANGLE" may be output from the speaker 230 when the puzzle piece 180 corresponding to a triangle (e.g., FIG. 7C) is placed in the corresponding receptacle 157.

According to one or more embodiments, the audible message can be in different languages. For instance, according to one embodiment, both English and Spanish names for the puzzle piece may be output, one after another (e.g., "APPLE . . . MANZANA" or "MANZANA . . . APPLE"). Alternatively, different languages may be selected using a selector (e.g., switch), for instance, on the body 110 (e.g., the bottom side 113). Thus, the audible messages may be output in a selected language, such as all English, all Spanish, etc.

Optionally, when all of the puzzle pieces 180 per drawer 150 have been detected to have been properly placed in their corresponding receptacles 157, a tone, a message, and/or a song may be output from the speaker 230. Such sound may be considered or characterized as a congratulatory sound for the user. After a predetermined amount of time upon completion of the puzzle for the open drawer 150, as counted by a timer of the processor 212, another sound may be output from the speaker 230 prompting the user to take further action. For instance, a message instructing the user to "CLOSE THE DRAWER" or the like may be outputted from the speaker 230.

Figure 10:
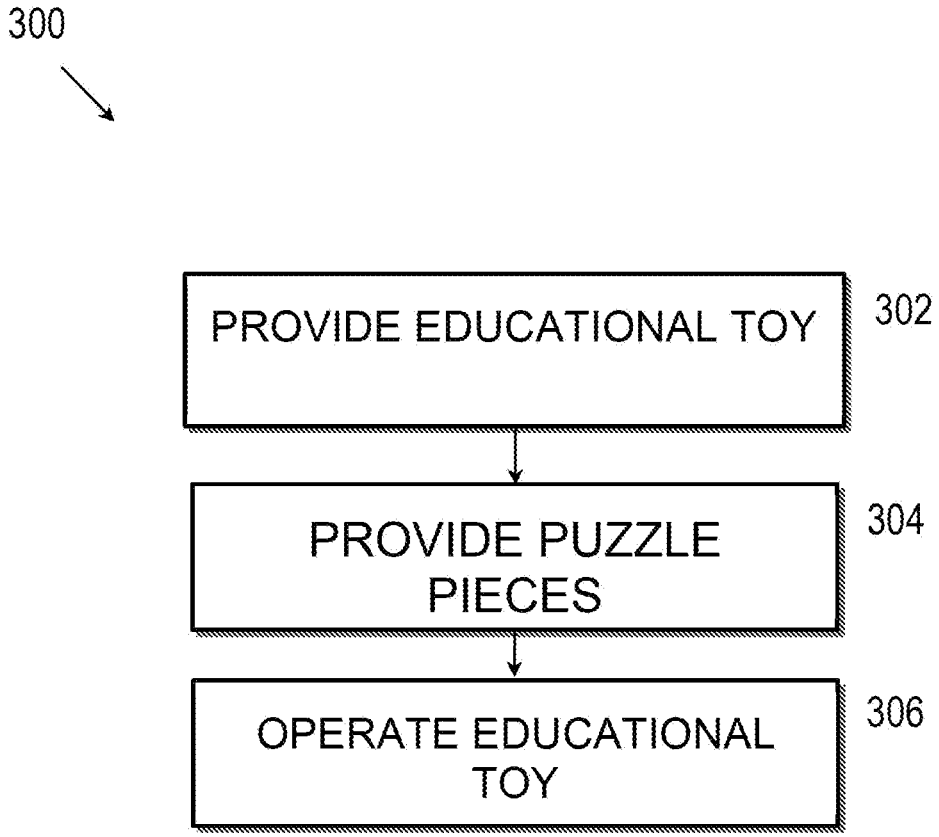
FIG. 10 is a flow chart of a method according to one or more embodiments of the disclosed subject matter.
Figure 11A:
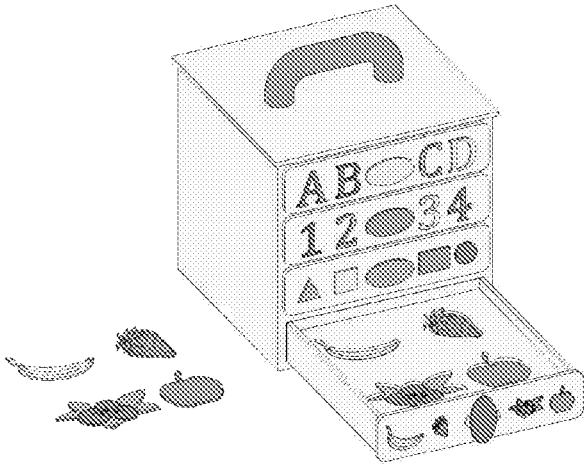
FIGS. 11A-11C show various operational or play states of the educational toy according to one or more embodiments of the disclosed subject matter.
Figure 11B:
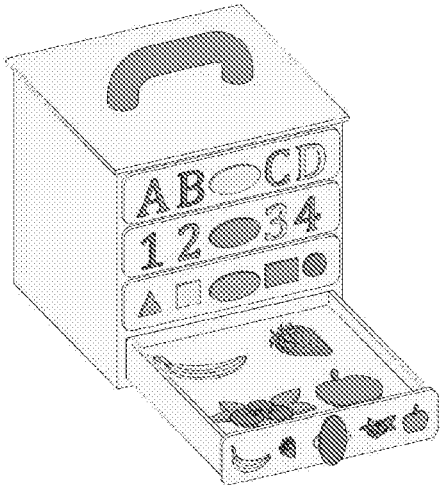
Figure 11C:
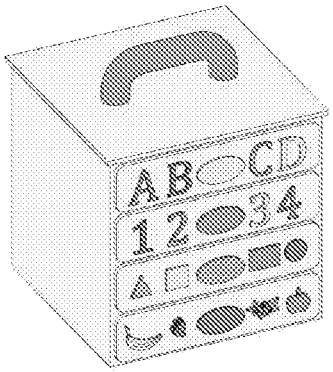

FIG. 10 is a flow chart of a method 300 according to one or more embodiments of the disclosed subject matter. FIGS. 11A-11C show various operational or play states of the educational toy 100 according to one or more embodiments of the disclosed subject matter. The states shown in FIGS. 11A-11C may be representative of some operations of the method 300. Implementation of some or all of the method 300, for instance, by a child, can help the child develop motor, coordination, and/or learning skills.

At 302 the method 300 can include providing an educational toy, such as educational toy 100 described herein.

At 304 the method 300 can include providing a plurality of puzzle pieces, such as puzzle pieces 180 described herein, for the educational toy. Optionally, the puzzle pieces can be provided with, i.e., as part of the educational toy.

At 306 the method 300 can include operating the educational toy. Generally, this can involve opening and closing drawers thereof, such as drawers 150. Operation can also include removal and placement of the puzzle pieces 180 relative to corresponding receptacles, such as receptacles 157, in each of the drawers 150. Various sounds may be emitted from the educational toy 100 depending upon the form of operation. For instance, sound may be emitted from a speaker, such as speaker 230, when one of the drawers 150 is opened (e.g., to the fully open state), when one of the drawers 150 is closed, and/or when one or all of the puzzle pieces 180 per drawer 150 is properly placed in its corresponding receptacle 157.

FIG. 11A, for instance, shows an operational state where a bottom drawer 150 has been opened to its fully open state and all of the puzzle pieces 180 have been removed from their corresponding receptacles. Optionally, the educational toy 100 may output an audible prompt (e.g., an audible message) from the speaker 230 instructing the user to place the puzzle pieces 180 in their respective receptacles 157.

FIG. 11B shows an operational state after the operational state of FIG. 11A, whereby all of the puzzle pieces 180 have been properly placed in their corresponding receptacles 157. As discussed above, upon properly placement of each individual puzzle piece 180, a sound may be emitted from the speaker 230. Generally, the sound may indicate the successful placement of the puzzle piece 180. For instance, the sound may identify the shape of the puzzle piece, for instance, "APPLE" in the case of a puzzle piece 180 in the shape of an apple being provided in its corresponding receptacle 157. Optionally, when all of the puzzle pieces have been properly placed in their corresponding receptacles 157 (per drawer 150), another sound may be output, wherein such sound may be considered or characterized as a congratulatory sound indicating successful completion, such as a melody, a song, a tune, or a message, e.g., "GREAT JOB!"

According to one or more embodiments, the audible message can be in different languages. For instance, according to one embodiment, both English and Spanish names for the puzzle piece may be output, one after another (e.g., "APPLE . . . MANZANA" or "MANZANA . . . APPLE"). Alternatively, different languages may be selected using a selector (e.g., switch), for instance, on the body 110 (e.g., the bottom side 113). Thus, the audible messages may be output in a selected language, such as all English, all Spanish, etc.

FIG. 11C shows an operational state after the operational state of FIG. 11B, whereby the bottom drawer 150 has been moved to the fully closed state. Here, all of the drawers 150 are in the fully closed state. The user may then open any one of the drawers 150 to manipulate the corresponding puzzle pieces 180 in the particular drawer.

Embodiments of the disclosed subject matter can also be according to the following parentheticals paragraphs.

(1) An educational toy for a child comprising: a body in the form of a square cube having a top side, a bottom side opposite the top side, a rear side, a first side, a second side opposite the first side, and a front side opposite the rear side; a plurality of drawers provided on the front side of the body, the plurality of drawers including only four drawers and being vertically aligned with each other on the front side of the body; a top handle extending from the top side of the body; and a plurality of puzzle pieces, wherein each of the plurality of drawers is movable between a fully open position and a fully closed position and includes: a body, a puzzle surface recessed in the body, the puzzle surface having a set of distinct recesses to receive a predefined set of the plurality of puzzle pieces, a handle extending from a front face of the body of the drawer, and a set of indicia corresponding to the predefined set of the plurality of puzzle pieces.

(2) The educational toy according to (1), wherein each of the indicia is in color according to a primary color or a secondary color.

(3) The educational toy according to (1) or (2), wherein the handle for each of the drawers is rotatable between a locked position and an unlocked position to lock and unlock the drawer, respectively, when the drawer is in the fully closed position.

(4) The educational toy according to any one of (1) to (3), wherein when each of the puzzle pieces is properly placed in a corresponding one of the distinct recesses, tops of the puzzle pieces do not project to a height greater than an amount by which the puzzle surface is recessed in the body such that the drawer is able to be moved to and from the fully closed position with the puzzle pieces in their respective distinct recesses.

(5) The educational toy according to any one of (1) to (4), wherein the drawers are configured such that only one of the four drawers is extendable to the fully open position at a time.

(6) The educational toy according to any one of (1) to (5), further comprising: a speaker; and a detector associated with each of the recesses to detect when one of the puzzle pieces has been properly fitted into a corresponding one of the recess, wherein the speaker is configured to output an audible message responsive to the detector detecting that one of the puzzle pieces has been properly fitted into the corresponding one of the recesses.

(7) The educational toy according to any one of (1) to (6), wherein each of the drawers includes one of said speakers and said detector.

(8) The educational toy according to any one of (1) to (7), further comprising circuitry configured to output another message from the speaker responsive to detection of all of the puzzle pieces per drawer being properly fitted into corresponding ones of the recesses.

(9) The educational toy according to any one of (1) to (8), further comprising a retention member to retain the drawers within respective receptacles in the body and prevent the drawers from being completely removed from the body.

(10) The educational toy according to any one of (1) to (9), wherein the puzzle pieces are retained in their respective recesses by magnetic force.

(11) A method comprising: providing an educational toy including a body and a plurality of drawers slidably coupled to the body, the drawers being in vertical alignment with each other, and the drawers each having a front plate on a front face side of the body; and providing a plurality of puzzle pieces for each of the drawers, wherein each of the drawers is slidable between a fully open position and a fully closed position and includes: a puzzle surface having a set of receptacles to receive a predefined set of the plurality of puzzle pieces, a handle extending from the front plate of the drawer, and a set of indicia corresponding to the predefined set of the plurality of puzzle pieces.

(12) The method according to (11), further comprising, with only one of the drawers in the fully open position: placing at least one of the puzzle pieces in a corresponding one of the receptacles in said one drawer in the fully open position; and outputting, via a speaker of the educational toy, an audible sound upon each occurrence of the puzzle piece being properly placed in the corresponding one of the receptacles of said one drawer in the fully open position.

(13) The method according to (11) or (12), further comprising outputting another, different audible sound from the speaker responsive to detection of all of the puzzle pieces per drawer being properly fitted into corresponding ones of the receptacles of said one drawer in the fully open position.

(14) The method according to any one of (11) to (13), further comprising outputting another, different audible sound from the speaker responsive to detection of opening and/or closing each of the drawers from/to the fully closed position.

(15) An educational apparatus for a child comprising: a body having a top side, a bottom side opposite the top side, a rear side, a first side, a second side opposite the first side, and a front side opposite the rear side; a plurality of drawers vertically aligned with each other on the front side of the body; and a plurality of puzzle pieces, wherein each of the plurality of drawers is movable between a fully open position and a fully closed position and includes: a puzzle surface having a set of receptacles to receive a predefined set of the plurality of puzzle pieces, and a handle extending from a front face of the drawer.

(16) The educational apparatus according to (15), wherein the handle for each of the drawers is rotatable between a locked position and an unlocked position to lock and unlock the drawer, respectively, in the fully closed position.

(17) The educational apparatus according to (15) or (16), further comprising circuitry and at least one speaker, wherein the circuitry is configured to control output of one or more messages via the speaker responsive to placement of one or more puzzle pieces in corresponding ones of the receptacles in the puzzle surface.

(18) The educational apparatus according to any one of (15) to (17), wherein the plurality of drawers includes only four drawers, and wherein indicia are provided on the front face of each of the drawers, the indicia corresponding to the puzzle pieces to be received by the set of receptacles for the drawer.

(19) The educational apparatus according to any one of (15) to (18), further comprising a locking mechanism to prevent, when one of the drawers is at least partially open, any other drawers from opening.

(20) The educational apparatus according to any one of (15) to (19), wherein when each of the puzzle pieces is properly placed in a corresponding one of the receptacles, tops of the puzzle pieces do not project to a height greater than an amount by which the puzzle surface is recessed in the body, such that the drawer is able to be moved to and from the fully closed position with the puzzle pieces in their respective corresponding receptacles.

As will be appreciated by one skilled in the art, aspects of the present disclosure may be embodied as a system, method, or at least partially in a computer program product. Accordingly, aspects of the present disclosure may take the form of an entirely hardware embodiment (for the circuitry), an entirely software embodiment (including firmware, resident software, micro-code, etc.) or an embodiment combining software and hardware aspects that may all generally be referred to herein as a "circuit," "module" or "system." Furthermore, aspects of the present disclosure may take the form of a computer program product embodied in one or more computer readable medium(s) having computer readable program code embodied thereon.

The functionality of the elements disclosed herein may be implemented using circuitry or processing circuitry which includes general purpose processors, special purpose processors, integrated circuits, ASICs ("Application Specific Integrated Circuits"), conventional circuitry and/or combinations thereof which are configured or programmed to perform the disclosed functionality. Processors are considered processing circuitry or circuitry as they include transistors and other circuitry therein. The processor may be a programmed processor which executes a program stored in a memory. In the disclosure, the circuitry, units, or means are hardware that carry out or are programmed to perform the recited functionality. The hardware may be any hardware disclosed herein or otherwise known which is programmed or configured to carry out the recited functionality. When the hardware is a processor which may be considered a type of circuitry, the circuitry, means, or units are a combination of hardware and software, the software being used to configure the hardware and/or processor.

Further, as used herein, the term "circuitry" can refer to any or all of the following: (a) hardware-only circuit implementations (such as implementations in only analog and/or digital circuitry); (b) to combinations of circuits and software (and/or firmware), such as (as applicable): (i) a combination of processor(s) or (ii) portions of processor(s)/software (including digital signal processor(s)), software and memory(ies) that work together to cause an apparatus, such as a mobile phone or server, to perform various functions); and (c) to circuits, such as a microprocessor(s) or a portion of a microprocessor(s), that require software or firmware for operation, even if the software or firmware is not physically present. This definition of "circuitry" can apply to all uses of this term in this application, including in any claims. As a further example, as used in this application, the term "circuitry" can also cover an implementation of merely a processor (or multiple processors) or portion of a processor and its (or their) accompanying software and/or firmware.

Use of the terms "data," "content," "information" and similar terms may be used interchangeably, according to some example embodiments of the present disclosure, to refer to data capable of being transmitted, received, operated on, and/or stored. The term "network" may refer to a group of interconnected computers or other computing devices. Within a network, these computers or other computing devices may be interconnected directly or indirectly by various means including via one or more switches, routers, gateways, access points or the like.

Aspects of the present disclosure have been described above with reference to flowchart illustrations and/or block diagrams of methods, apparatus (systems) and computer program products according to embodiments of the present disclosure. In this regard, the flowchart and block diagrams in the Figures illustrate the architecture, functionality, and operation of possible implementations of systems, methods and computer program products according to various embodiments of the present disclosure. For instance, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

It also will be understood that each block of the flowchart illustrations and/or block diagrams, and combinations of blocks in the flowchart illustrations and/or block diagrams, can be implemented by computer program instructions. These computer program instructions may be provided to a processor of a general-purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks. The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

It must be noted that, as used in the specification and the appended claims, the singular forms "a," "an," and "the" include plural referents unless the context clearly dictates otherwise. That is, unless clearly specified otherwise, as used herein the words "a" and "an" and the like carry the meaning of "one or more." The use of the term "at least one" followed by a list of one or more items (for example, "at least one of A and B" or one or more of A and B") is to be construed to mean one item selected from the listed items (A or B) or any combination of two or more of the listed items (A and B; A, A and B; A, B and B), unless otherwise indicated herein or clearly contradicted by context. Similarly, as used herein, the word "or" refers to any possible permutation of a set of items. For example, the phrase "A, B, or C" refers to at least one of A, B, C, or any combination thereof, such as any of: A; B; C; A and B; A and C; B and C; A, B, and C; or multiple of any item such as A and A; B, B, and C; A, A, B, C, and C; etc.

Additionally, it is to be understood that terms such as "left," "right," "top," "bottom," "front," "rear," "side," "height," "length," "width," "upper," "lower," "interior," "exterior," "inner," "outer," and the like that may be used herein, merely describe points of reference and do not necessarily limit embodiments of the disclosed subject matter to any particular orientation or configuration. Furthermore, terms such as "first," "second," "third," etc., merely identify one of a number of portions, components, points of reference, operations and/or functions as described herein, and likewise do not necessarily limit embodiments of the disclosed subject matter to any particular configuration or orientation.

While aspects of the present disclosure have been particularly shown and described with reference to the embodiments above, it will be understood by those skilled in the art that various additional embodiments may be contemplated by the modification of the disclosed machines, assemblies, systems, and methods without departing from the spirit and scope of what is disclosed. Such embodiments should be understood to fall within the scope of the present disclosure as determined based upon the claims and any equivalents thereof.

The invention claimed is:

1. An educational toy for a child comprising:

a first body in the form of a square cube having a top side, a bottom side opposite the top side, a rear side, a first side, a second side opposite the first side, and a front side opposite the rear side;

a plurality of drawers provided on the front side of the first body, the plurality of drawers including only four drawers and being vertically aligned with each other on the front side of the first body;

a top handle extending from the top side of the first body; and a plurality of puzzle pieces, wherein each of the plurality of drawers is movable between a fully open position and a fully closed position and includes:

a second body, a puzzle surface recessed in the second body, the puzzle surface having a set of distinct recesses to receive a predefined set of the plurality of puzzle pieces, a handle extending from a front face of the second body of the drawer, and a set of indicia corresponding to the predefined set of the plurality of puzzle pieces, wherein the toy further comprises a speaker; and a detector associated with each of the recesses to detect when one of the puzzle pieces has been properly fitted into a corresponding one of the recess, wherein the speaker is configured to output an audible message responsive to the detector detecting that one of the puzzle pieces has been properly fitted into the corresponding one of the recesses.

2. The educational toy according to claim 1, wherein each of the indicia is in color according to a primary color or a secondary color.

3. The educational toy according to claim 1, wherein the handle for each of the drawers is rotatable between a locked position and an unlocked position to lock and unlock the drawer, respectively, when the drawer is in the fully closed position.

4. The educational toy according to claim 1 wherein when each of the puzzle pieces is properly placed in a corresponding one of the distinct recesses, tops of the puzzle pieces do not project to a height greater than an amount by which the puzzle surface is recessed in the second body such that the drawer is able to be moved to and from the fully closed position with the puzzle pieces in their respective distinct recesses.

5. The educational toy according to claim 1, wherein the drawers are configured such that only one of the four drawers is extendable to the fully open position at a time.

6. The educational toy according to claim 1, wherein each of the drawers includes one of said speakers and said detector.

7. The educational toy according to claim 1, further comprising circuitry configured to output another message from the speaker responsive to detection of all of the puzzle pieces per drawer being properly fitted into corresponding ones of the recesses.

8. The educational toy according to claim 1, further comprising a retention member to retain the drawers within respective receptacles in the body and prevent the drawers from being completely removed from the body.

9. The educational toy according to claim 1, wherein the puzzle pieces are retained in their respective recesses by magnetic force.

10. A method comprising:

providing an educational toy including a body and a plurality of drawers slidably coupled to the body, the drawers being in vertical alignment with each other, and the drawers each having a front plate on a front face side of the body; and providing a plurality of puzzle pieces for each of the drawers, wherein each of the drawers is slidable between a fully open position and a fully closed position and includes:

a puzzle surface having a set of receptacles to receive a predefined set of the plurality of puzzle pieces, a handle extending from the front plate of the drawer, and a set of indicia corresponding to the predefined set of the plurality of puzzle pieces, wherein with only one of the drawers in the fully open position:

placing at least one of the puzzle pieces in a corresponding one of the receptacles in said one drawer in the fully open position; and outputting, via a speaker of the educational toy, an audible sound upon each occurrence of the puzzle piece being properly placed in the corresponding one of the receptacles of said one drawer in the fully open position.

11. The method according to claim 10, further comprising outputting another, different audible sound from the speaker responsive to detection of all of the puzzle pieces per drawer being properly fitted into corresponding ones of the receptacles of said one drawer in the fully open position.

12. The method according to claim 10, further comprising outputting another, different audible sound from the speaker responsive to detection of opening and/or closing each of the drawers from/to the fully closed position.

13. An educational apparatus for a child comprising:

a body having a top side, a bottom side opposite the top side, a rear side, a first side, a second side opposite the first side, and a front side opposite the rear side;

a plurality of drawers vertically aligned with each other on the front side of the body; and a plurality of puzzle pieces, wherein each of the plurality of drawers is movable between a fully open position and a fully closed position and includes:

a puzzle surface having a set of receptacles to receive a predefined set of the plurality of puzzle pieces, and a handle extending from a front face of the drawer, wherein the toy further comprises circuitry and at least one speaker, wherein the circuitry is configured to control output of one or more messages via the speaker responsive to placement of one or more puzzle pieces in corresponding ones of the receptacles in the puzzle surface.

14. The educational apparatus according to claim 13, wherein the handle for each of the drawers is rotatable between a locked position and an unlocked position to lock and unlock the drawer, respectively, in the fully closed position.

15. The educational apparatus according to claim 13, wherein the plurality of drawers includes only four drawers, and wherein indicia are provided on the front face of each of the drawers, the indicia corresponding to the puzzle pieces to be received by the set of receptacles for the drawer.

16. The educational apparatus according to claim 13, further comprising a locking mechanism to prevent, when one of the drawers is at least partially open, any other drawers from opening.

17. The educational apparatus according to claim 13, wherein when each of the puzzle pieces is properly placed in a corresponding one of the receptacles, tops of the puzzle pieces do not project to a height greater than an amount by which the puzzle surface is recessed in the body, such that the drawer is able to be moved to and from the fully closed position with the puzzle pieces in their respective corresponding receptacles.

* * * * *